United States Patent [19]

Mimura et al.

[11] Patent Number: 4,701,042

[45] Date of Patent: Oct. 20, 1987

[54] DUPLICATING APPARATUS

[75] Inventors: Yoshiyuki Mimura; Yasuo Isono, both of Hachioji, Japan

[73] Assignee: Olympus Optical Co., Ltd., Tokyo, Japan

[21] Appl. No.: 803,150

[22] Filed: Dec. 2, 1985

[30] Foreign Application Priority Data

Dec. 3, 1984 [JP] Japan ..... 59-255207

[51] Int. Cl.[4] ..... G03G 15/08

[52] U.S. Cl. ..... 355/3 DD; 355/140

[58] Field of Search ..... 355/3 R, 3 DD, 10, 14 D; 118/657, 658

[56] References Cited

U.S. PATENT DOCUMENTS 3,907,423 9/1975 Hayashi et al. ..... 355/10
3,981,267 9/1976 Gardiner et al. ..... 355/10 X
3,981,576 9/1976 Inoue ..... 355/10 X
4,325,627 4/1982 Swidler et al. ..... 355/10
4,420,244 12/1983 Landa ..... 355/10 X

FOREIGN PATENT DOCUMENTS 56-119142 9/1981 Japan .

*Primary Examiner*—Fred L. Braun
*Attorney, Agent, or Firm*—Fleit, Jacobson, Cohn & Price

[57] ABSTRACT

A duplicating apparatus including a charge retentive drum arranged rotatably, an electrostatic latent image forming device, a non-contact type developing device, a transferring device for transferring a toner image onto a record paper and a fixing device for fixing the toner image onto the record paper. A correction electrode is provided between the developing device and transferring device and an AC bias voltage is applied to the correction electrode to generate a vibrating electric field. Image quality of the duplicated copies can be improved by passing the toner image through the vibrating electric field.

17 Claims, 5 Drawing Figures

DUPLICATING APPARATUS

BACKGROUND OF THE INVENTION

1. Field of the Invention

The present invention relates to a duplicating apparatus, and more particularly a duplicating apparatus for forming a plurality of copies having the same image by repeatedly developing one and the same electrostatic latent image.

2. Related Art Statement

Heretofore, there has been practised a duplicating apparatus in which after an electrostatic latent image has been once formed on a charge retentive member, development and transfer are repeatedly effected to form a plurality of copies from the same latent image. In such a retention type duplicating apparatus it is important that the electrostatic latent image should not be deteriorated or decayed during the repetitive development and transfer. For instance, when the latent image is developed by a magnetic brush developing device using a two component developing agent consisting of magnetic carriers and toners, it has been tried to avoid a leakage of electrostatic charge by increasing the resistance of the developing agent or adjusting the developing bias voltage, and to avoid fog which is induced on an imagewise bright area by an injection of charge due to friction between the developing agent and a charge retentive member, e.g. a photosensitive body. However, such known measures could not provide a satisfactory solution, and usually it is quite difficult to obtain more than thirty duplicated copies from the single latent image.

In order to mitigate the above mentioned drawbacks, in Japanese Patent Kokai Sho No. 56-119,142 there has been proposed a non-contact type developing device comprising a developing roller having an AC bias applied thereto. In such a developing device, toner particles are alternately moved toward the charge retentive member and toward the developing roller by means of a transporting electric field and an anti-transporting electric field, which are generated alternately by the AC bias applied to the developing roller. In this device, it is possible to obtain a duplicated copy having a relatively good image quality. However, in this known device, since the AC bias voltage is applied directly to the developing roller, the latent image potential is reduced to about two-thirds of the original surface potential after forming about forty copies from the same latent image.

In other electrophotographic apparatuses than the above-mentioned retention type apparatus, the reproducibility of a fine line is not satisfactory and a density of the fine line is not high. The density of the fine line can be increased by utilizing the edge effect. However, if the edge effect is used, there occurs another problem in that a large black area could not be reproduced at a constant density. Further, in the known duplicating apparatus, a so-called $\gamma$-characteristic of the density of the reproduced image is too steep to obtain a good gradation.

SUMMARY OF THE INVENTION

The present invention has for one object to provide a novel and useful duplicating apparatus which can overcome the drawbacks mentioned above and can provide excellent reproducibility of fine lines and gradation without fog.

It is another object of the invention to provide a retention type duplicating apparatus in which the electrostatic charge of a latent image can be maintained unchanged even if a number of copies are formed from the same latent image by repeated development and transfer.

According to the invention, a duplicating apparatus comprises

- means for forming an electrostatic latent image on a charge retentive member;
- means for developing the electrostatic latent image with toners to form a toner image;
- means comprising a correction electrode arranged opposite to the charge retentive member and an AC bias voltage source connected to the correction electrode to form a vibrating electric field between the charge retentive member and correction electrode, said toner image being passed through said vibrating electric field;
- and means for transferring the toner image passed through the vibrating electric field onto an image receiving member.

DESCRIPTION OF THE PREFERRED EMBODIMENTS

Figure 1:
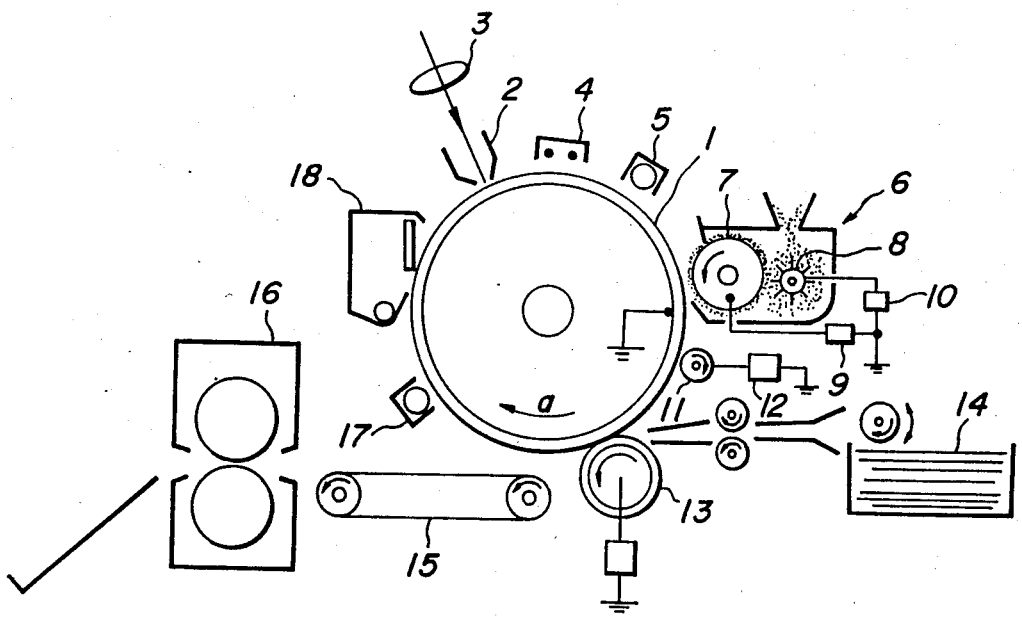
FIG. 1 is a schematic cross sectional view showing an embodiment of a duplicating apparatus according to the invention.

FIG. 1 is a cross-sectional view showing schematically an embodiment of the duplicating apparatus according to the invention. The apparatus comprises a photosensitive drum 1 arranged rotatably in a direction shown by an arrow a. The photosensitive drum 1 comprises a selenium photosensitive layer applied on an aluminum base connected to the ground and an insulating film applied on the photosensitive layer. The photosensitive drum 1 is uniformly charged in a positive polarity by a charger 2 and at the same time is subjected to an imagewise exposure by means of an exposing device 3. After that the photosensitive drum 1 is charged in a negative polarity by a charger 4 and then is uniformly illuminated by a lamp 5 to form an electrostatic latent image made of negative charge. Next, the electrostatic latent image thus formed on the photosensitive drum 1 is developed with toners to form a toner image by means of a developing device 6. In the present embodiment, the developing device 6, which comprises a developing roller 7 arranged rotatably in opposition to the photosensitive drum 1 and a magnetic brush 8 arranged rotatably in opposition to the developing roller 7. The magnetic brush 8 serves to charge toner particles with a positive polarity due to friction between insulating toners and magnetic carriers. A first bias voltage source 9 is connected to the developing roller 7 to apply a developing bias voltage of −200 V, and a second bias voltage source 10 is connected to the magnetic brush 8 to apply a transporting bias voltage of +500 V. Due to an electric field generated by the transporting bias voltage, toners charged with a positive polarity are transported to the developing roller 7 and a toner layer having a given thickness is formed on the developing roller. There is formed an air gap of about 30 to 200 μm between the photosensitive drum 1 and the toner layer. Therefore, the present developing device 6 is of the non-contact type. Toners retained on the developing roller 7 was subjected to an electrostatic force due to an electric field formed by the electrostatic latent image on the photosensitive drum 1, and some toners are transported across the air gap onto the photosensitive drum 1 and are adhered thereon to develop the latent image. The toner image thus developed on the photosensitive drum 1 is then transported under a correction electrode 11 arranged in opposition to the photosensitive drum 1. In the present embodiment, the correction electrode is formed by a conductive roller arranged rotatably in a clockwise direction. The conductive roller is separated from the photosensitive drum 1 by a distance of 0.5 to 3 mm and is connected to a correction bias voltage source 12. The correction bias voltage source 12 may be constituted by an AC bias voltage source generating sinusoidal or rectangular waves or an AC bias voltage source generating an AC voltage superimposed with DC voltage. The AC bias voltage has preferably a peak-to-peak value of 1,000 to 5,000 volts and a frequency of 500 to 2,000 Hz. When the AC bias voltage source generating the AC voltage is superimposed with the DC voltage, the DC voltage is preferably 0 to −2,000 volts for a negative charge latent image and 0 to +2,000 volts for a positive charge latent image.

According to the invention, between the photosensitive drum 1 and correction electrode 11 is formed a vibrating electric field, and when toners applied on the photosensitive drum 1 are passed through the vibrating electric field, they are subjected alternately to a forward force directed to the photosensitive drum and a backward force directed to the correction electrode 11. Therefore, some toners applied on a non-pictorial area in the latent image are separated from the photosensitive drum 1, and some toners are moved or shifted laterally along the photosensitive drum surface into a pictorial area due to the operation of the vibrating electric field. Further, in the vicinity of an image edge, toners applied on the non-pictorial area are removed or moved toward the pictorial area. The above-explained function of the correction electrode 11 becomes manifest when the AC bias voltage superimposed with the DC voltage is applied to the correction electrode 11. In this manner, according to the invention, toners applied on the non-pictorial area can be removed effectively, and therefore the fog can be decreased and the resolution can be increased. Moreover, if an excessive amount of toner is applied to the pictorial area in a multi-layer manner, toners in the uppermost layer are brought into an easily movable condition by the vibrating electric field and are transported onto the correction electrode 11 against the electric field generated by the electrostatic latent image. Further, toners applied to the correction electrode 11 are transported onto the pictorial area on which a sufficient amount of toners has not been adhered. In this manner, on the pictorial area of the latent image there is applied a correct amount of toners in accordance with the latent image potential, and thus the density of a fine line can be increased. Moreover, in the present embodiment since use is made of the noncontact type developing device 6, the potential of the latent image formed on the photosensitive drum 1 can remain unchanged even if the latent image is repeatedly subjected to developing and transfer.

The toner image thus corrected is moved into a transfer section and is transferred onto a record paper 14, fed in synchronism with the rotation of the photosensitive drum 1 between the photosensitive drum and a transfer roller 13. The toner image thus transferred on the record paper 14 is fed by a feeding device 15 into a fixing device 16 and is fixed onto the record paper. Finally the record paper 14 having the toner image fixed thereon is discharged on a tray.

After the transfer, the photosensitive drum 1 is subjected to an erasing operation by means of an eraser 17 comprising an erasing lamp and erasing corona charger. Any toners remain on the photosensitive drum 1 are removed by a cleaning device 18 to prepare for the next latent image formation. It should be noted that if a plurality of copies are to be formed from a single latent image once formed on the photosensitive drum 1, the erasing device 17 and cleaning device 18 remain inoperative until the toner image is transferred onto the last record paper.

Now the present invention will be explained with reference to some experimental examples.

EXAMPLE 1

Experimental condition:

| | |
|---|---|
| (1) latent image potential | |
| pictorial area | −550 V |
| non-pictorial area | +100 V |
| (2) amount of charge on toner | 3 μC/g |
| (3) thickness of toner layer on developing roller | 80 μm |
| (4) air gap between toner layer and photosensitive drum | 100 μm |
| (5) bias to correction electrode voltage superimposed with DC bias voltage<br>+Vmax = 1,000 V<br>−Vmax = 2,000 V | AC bias |

The following table 1 represents various duplicating properties of the apparatus according to the invention, in comparison with those of the known duplicating apparatus having no correction electrode.

TABLE 1

| | With correction electrode | Without correction electrode |
|---|---|---|
| Fog in non-pictorial area | 0.07 | 0.1 |
| Resolution | 7 lines/mm | 4 lines/mm |
| Density of fine lines | 0.60 | 0.38 |

Note:
Density of fine lines was measured by using an oblique section original having a density of 0.5 and resolution of 3 lines/mm.

As can be understood from Table 1, in the duplicating apparatus having the correction electrode for correcting the toner image on the photosensitive drum by the vibrating electric field, in fog in the non-pictorial area can be decreased to a large extent and the resolution and the density of fine lines can also be improved.

Figure 2:
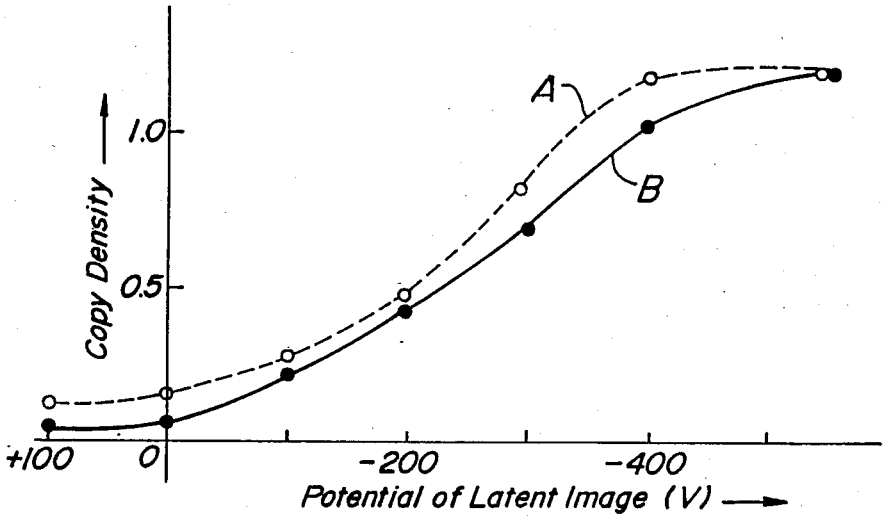
FIG. 2 is a graph illustrating the relation between latent image potential and copy density.

FIG. 2 is a graph showing the relation between the copy density and the potential of the electrostatic latent image. A curve A represents the property of the known duplicating apparatus having no correction electrode and a curve B depicts the property of the duplicating apparatus with the correction electrode according to the invention. From the curve A, it is clear that in the middle range of the latent image potential of −200−−400 V, the density increases abruptly, and the density is saturated at about −400 V. Contrary to this, according to the invention, the density of the developed image increases gradually in the middle range and is not saturated at about −400 V.

Figure 3:
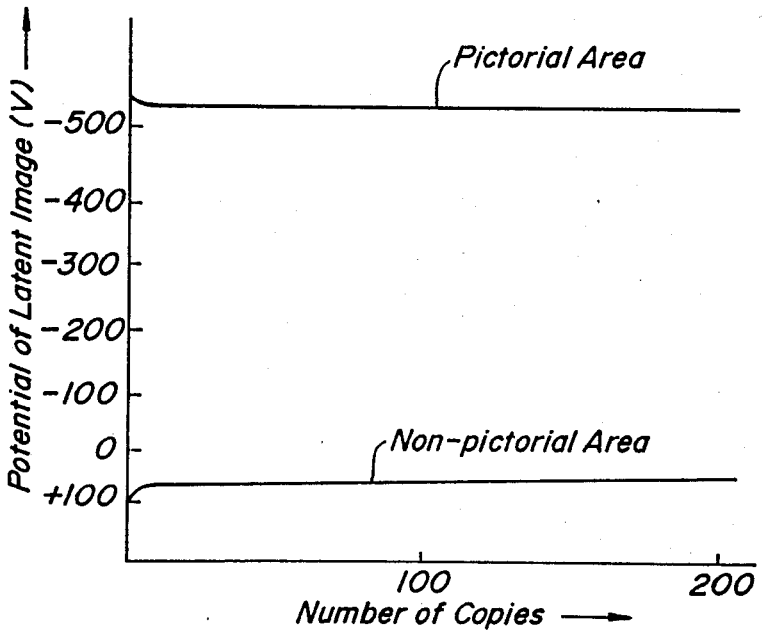
FIG. 3 is a graph depicting the relation between the number of copies and the latent image potential.

FIG. 3 is a graph showing the variation of the potential of the electrostatic latent image during the formation of 200 copies from the same latent image without effecting erasing and cleaning. According to the invention, since the vibrating electric field is generated by the correction electrode, although the latent image potential is slightly changed during the duplication of the first few copies, the potential is substantially not varied during the formation of the remaining copies. That is to say, after 200 copies have been duplicated, the latent image retains substantially the initial potential in both the pictorial and non-pictorial areas.

EXAMPLE 2

In this example, the toner layer formed on the developing roller is brought into contact with the photosensitive drum to form a toner image, and a bias voltage of rectangular wave form having a frequency of 1,500 Hz is applied to the correction electrode in such a manner that +Vmax is +300 V and −Vmax is −1,200 V. In this experiment, it has been confirmed that the fog and gradation are substantially the same as those of the apparatus having no correction electrode. However, the resolution is improved from 5 lines/mm to 7 lines/mm and the density of the fine lines is also improved from 0.45 to 0.60.

Figure 4:
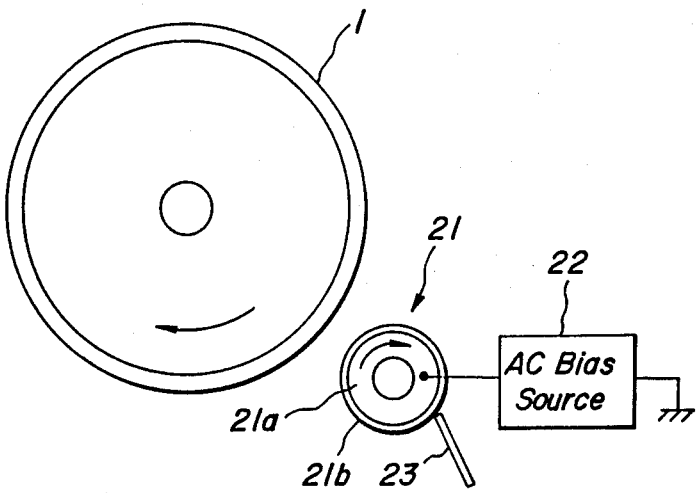
FIG. 4 is a schematic view showing another embodiment of a duplicating apparatus according to the invention.

FIG. 4 is a schematic view showing another embodiment of the correction electrode of duplicating apparatus according to the invention. In this embodiment, the correction electrode 21 is formed by a conductive roller 21*a* and a thin insulating film 21*b* applied to the surface of the roller. The correction electrode 21 is arranged opposite to the photosensitive drum 1 and is rotated in the clockwise direction as shown by the arrow. The conductive roller 21*a* is connected to an AC bias voltage source 22. There is further arranged a scraper 23 having one edge brought into contact with the correction electrode 21. The scrapper 23 serves to remove any toners on the correction electrode 21.

Figure 5:
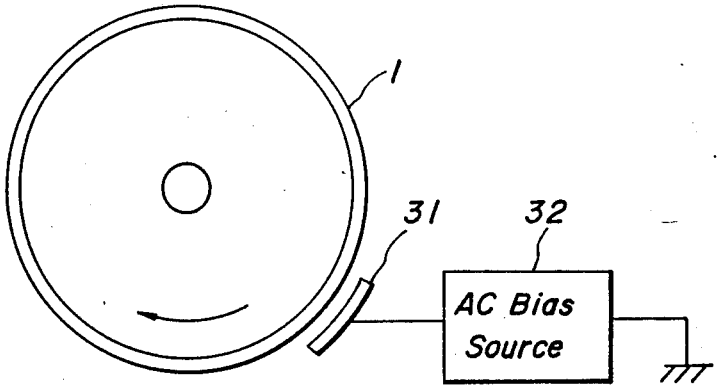
FIG. 5 is a schematic view illustrating still another embodiment of a duplicating apparatus according to the invention.

FIG. 5 is a schematic view showing still another embodiment of a correction electrode according to the invention. In this embodiment, the correction electrode is formed by a curved metal plate 31 fixedly arranged in opposition to the photosensitive drum 1. The plate 31 is coupled with an AC bias voltage source 32. In the present embodiment, the correction electrode 31 can be made simple and can be easily mounted.

The present invention is not limited to the embodiments explained above, but may be modified within the scope of the invention. For instance, in the above embodiment, the duplicating apparatus is constructed as an electrophotographic apparatus, but according to the invention, the duplicating apparatus may be constructed in the form of a printer in which an electrostatic latent image is formed on a dielectric drum by an electrostatic recording head. Further, in the above embodiment, a thin insulating film may be applied to the surface of the developing roller. Moreover, the developing device may be formed as various types, such as a cascade developing device, a fur brush developing device, a smoke developing device and an impression developing device. Further, in the case of use of a non-contact developing device, it is not always necessary to apply the DC bias to the developing roller, but an AC bias or no bias may be applied to the developing roller. However, when an AC bias is applied to the developing electrode, the potential of the electrostatic latent image might be varied.

As explained above in detail, according to the invention, after the electrostatic latent image is developed, the toner image is corrected by transporting it through the vibrating electric field generated between the charge retentive member and the correction electrode, and therefore toners applied in the nonpictorial area on the charge retentive member can be removed from the charge retentive member so that fog is decreased. Further, toners applied to the charge retentive member in the non-pictorial area side of the image edge are removed or shifted into the pictorial area side, so that resolution is increased to obtain sharp copies. Further, the density of fine lines is increased and the gradation is also improved.

Therefore, according to the invention, the image quality of duplicated copies can be improved materially. Moreover, when use is made of a non-contact type developing device and the decay of the potential of the latent image can be decreased, a large number of copies can be formed by repeatedly developing the same electrostatic latent image once formed on the charge retentive member. In such an apparatus, since the AC bias is not applied to the developing electrode, but to the correction electrode, the allowable range of developing conditions can be widened. For instance, the thickness of the air layer between the toner layer formed on the developing roller and the charge retentive member can be selected from a wide range, and freedom in designing the duplicating apparatus can be increased.

What is claimed is:

1. A duplicating apparatus comprising:

a rotatably mounted charge retentive member;

forming means for forming an electrostatic latent image on the charge retentive member;

developing means for developing the electrostatic latent image with toner particles of a dry developer to form a toner image;

correction means comprising a correction electrode arranged opposite to the charge retentive member with a predetermined gap therebetween and an AC bias voltage source connected to the correction electrode to form a vibrating electric field in the gap between the charge retentive member and the correction electrode, for redistributing the toner particles within the image by alternate attraction and repulsion of the toner particles by the correction electrode responsive to said toner image being passed through said vibrating electric field;

and means for transferring onto a image receiving member the toner image that has been passed through the vibrating electric field.

2. An apparatus according to claim 1, wherein said developing means comprises a non-contact type developing device including a developing roller on which a toner layer is applied, the toner layer being separated from the charge retentive member by a small air gap.

3. An apparatus according to claim 2, wherein said developing means further comprises a bias voltage source connected to the developing roller.

4. An apparatus according to claim 2, wherein a plurality of copies are formed from one and the same electrostatic latent image once formed on the charge retentive member by repeating development and transfer successively.

5. An apparatus according to claim 1, wherein said correction electrode comprises a rotatable conductive roller.

6. An apparatus according to claim 5, wherein said correction electrode further comprises an insulating film applied on the conductive roller.

7. An apparatus according to claim 5, further comprising a scraper having one edge in contact with the conductive roller.

8. An apparatus according to claim 1, wherein said charge retentive member is formed as a rotatable drum.

9. An apparatus according to claim 1, wherein said bias voltage source for the correction electrode comprises a voltage source for generating an AC voltage having a sinusoidal wave form.

10. An apparatus according to claim 1, wherein said means for applying the bias voltage to the correction electrode comprises an AC voltage source for generating an AC voltage having a rectangular wave form.

11. An apparatus according to claim 1, wherein said bias voltage source for the correction electrode comprises a generator for generating an AC voltage superimposed with a DC voltage having a polarity opposite to that of the toners.

12. An apparatus according to claim 1, wherein said correction electrode is spaced from the charge retentive member by a distance of from about 0.5 to about 3 mm.

13. An apparatus according to claim 1, wherein said correction electrode comprises a conductive plate positioned in fixed relationship with respect to the charge retentive member.

14. An apparatus according to claim 1 wherein the developing means includes a rotatably mounted developing roller, coating means for coating a dry developer including toner particles on the surface of the developing roller and bias means for establishing a bias on the developing roller with respect to said charge retentive member such that the toner particles transfer to develop the electrostatic latent image, said developing roller being positioned relative to the charge retentive member with a predetermined gap therebetween.

15. An apparatus according to claim 1 wherein the vibrating electric field has a peak-to-peak value of from about 1000 to about 5000 volts and a frequency of from about 500 to about 2000 Hz superimposed on a D.C. voltage up to about −2000 volts for a latent image of negative polarity and up to about +2000 volts for a latent image of positive polarity.

16. An apparatus according to claim 1 wherein the redistributing of toner particles includes removing toner particles from non-pictorial areas of the image.

17. An apparatus according to claim 1 wherein the redistributing of toner particles includes moving toner particles within the image from non-pictorial areas to pictorial areas.

* * * * *